US006793451B2

(12) United States Patent
Neufeldt

(10) Patent No.: US 6,793,451 B2
(45) Date of Patent: Sep. 21, 2004

(54) GARBAGE OR RECYCLABLE MATERIALS HANDLING CONTAINER

(75) Inventor: Dennis Neufeldt, Lethbridge (CA)

(73) Assignee: Haul-All Equipment Ltd., Lethbridge (CA)

( * ) Notice: Subject to any disclaimer, the term of this patent is extended or adjusted under 35 U.S.C. 154(b) by 0 days.

(21) Appl. No.: 10/125,944

(22) Filed: Apr. 19, 2002

(65) Prior Publication Data

US 2002/0154978 A1 Oct. 24, 2002

(30) Foreign Application Priority Data

Apr. 20, 2001 (CA) ..... 2344801

(51) Int. Cl.[7] ..... B65B 21/02
(52) U.S. Cl. ..... 414/422; 414/406; 414/421
(58) Field of Search ..... 414/422, 421, 414/406

(56) References Cited

U.S. PATENT DOCUMENTS 3,270,900 A * 9/1966 Sherman ..... 414/303
3,279,763 A * 10/1966 Seman ..... 366/39
3,774,792 A * 11/1973 Willmroth ..... 414/416.09
4,280,780 A 7/1981 Neufeldt
4,859,135 A 8/1989 Neufeldt
6,077,020 A 6/2000 Neufeldt et al.

FOREIGN PATENT DOCUMENTS

CA 1072511 2/1980
CA 2187856 4/1998

* cited by examiner

*Primary Examiner*—Eileen D. Lillis
*Assistant Examiner*—Michael Lowe
(74) *Attorney, Agent, or Firm*—Dinsmore & Shohl LLP

(57) ABSTRACT

A garbage or recyclable material handling system uses material containers each pivotally mounted to respective supports at desired locations for movement between a lower material receiving position and a partially inverted material discharge position. At least one materials collection vehicle is provided to communicate with respective containers when in the discharge position to receive the materials discharged therefrom.

6 Claims, 6 Drawing Sheets

GARBAGE OR RECYCLABLE MATERIALS HANDLING CONTAINER

BACKGROUND OF THE INVENTION

This invention relates generally to improvements in garbage or recyclable materials handling containers.

The prior art has provided a wide variety of garbage and recyclable materials containers and collection equipment. One problem with traditional front loading containers is that the collection truck typically requires a minimum of 15 meters (50 feet) directly in front of the bin to be collected. Sloped locations also pose difficulties with these containers as the front loading collection trucks require the bin to be substantially level to mate with the lift forks on the collection vehicle. Rear loading bins typically have wheels which can cause handling problems on slopes. Also, bins with wheels typically require two or more persons to move them into place so that they can be tipped into the hopper of the rear loading truck. Wheeled bins are also a problem in locations where a "permanent" site is desired such as a recycling depot. A site can lose its functionality if the bins are disoriented. Side loading bins that are lifted and emptied into the collection body also have the problem with "permanence" and require a complex and expensive lifting mechanism, usually with a limited reach, to empty the containers. Furthermore, the lifting of front, side or rear loading bins creates more stress on the lids resulting in distortions and failures. Open lids are not only unsightly but are unsanitary and make bins susceptible to animals and fire.

Stationary, self-dumping containers are also known. These typically include a base which may be rigidly secured to a concrete pad and a hopper which is pivotally secured to the base and which is pivoted by one or more hydraulic cylinders between a lower loading position and an elevated discharge position. This rotating action is relatively smooth compared to the lifting action and allows these self-dumping containers to be provided with relatively heavy discharge lids and loading lids with a latch, rendering them substantially inaccessible to animals.

In addition to being very effective in keeping very large animals, particularly bears, out of the garbage or recyclables, these self-dumping units lend themselves to more aesthetic designs and therefore makes the container well suited for high profile locations. The container can also maintain its good looks for an extended period of time because the collection vehicle is never required to make actual contact with the container to empty the contents. The above noted problems of access are substantially eliminated since a side loading collection vehicle with a side mounted bucket can access a self-dumping bin by driving along side of it. One example would have the collection truck on the road emptying a stationary container on the opposite side of the sidewalk. Another example would be where a cluster of these containers has been laid out as in a recycling depot. A stationary self-dumping container can be collected using the normal driving lanes in a parking lot while in contrast a typical front loader would need a large amount of space for each container. Furthermore, since the stationary bin does not have to be actually lifted by the collection truck, smaller collection vehicles can be used thus providing advantages in terms of both capital and operating costs. Additionally, because the stationary self-dumping container involves dumping of material into the side mounted loading bucket, there is an opportunity to inspect the material before it enters the compactor. This is particularly usefull in recycling applications to check for unwanted materials or contaminants.

The self-dumping containers described in Canadian Patent No. 1,072,511 (U.S. Pat. No. 4,208,780) and Canadian Application No. 2,187,856 (U.S. Pat. No. 6,077,020) include all of the advantages noted above and they have proven cost effective in many applications where the required storage capacity is in the range of four to six cubic yards. However, these containers have several disadvantages.

The first disadvantage is in terms of cost for smaller capacities. The rotation required to empty the contents from these containers is typically 135 degrees. In order to accomplish this rotation a substantial frame is required so the result of "down sizing" isn't very cost effective.

The second disadvantage involves the container going "over centre" as a result of the 135 degree rotation. A counterbalance is required to compensate for this "over centre" weight, as well as double acting hydraulics to pull the hopper back to the loading position.

Another limiting factor in the design is that the containers are most efficient when loading is done on the opposite side as the unloading. The adjacent side can be used but may not utilize the full capacity whereas the frame on the unloading side limits the access to that side of the bin. This opposite side requirement adds to the "footprint" of the container i.e. adds to the space required for installation. In many applications, space is of essence and could be the deciding factor in whether or not to purchase a particular type of bin.

It is therefore desirable to provide a container that incorporates the advantages of the containers noted above and which therefore is capable of enjoying widespread application and increased commercial value.

SUMMARY OF THE INVENTION

It is accordingly an object of the present invention to provide a garbage/recyclable container which alleviates the major disadvantages while maintaining most of the advantages associated with the stationary self-dumping containers noted above.

It is a further object of this invention to provide a container that requires less rotation than known types of self-dumping containers and to achieve this rotation substantially within the footprint of the container.

It is a general object of the present invention to provide a garbage/recyclable container which is capable of operating in tight locations, especially locations where loading and unloading are required from the same side of the container. It is also the intent of the present invention to provide aesthetic containers that can be used in high profile locations rather than behind residential or commercial buildings and the like.

It is also an object of the present invention to provide apparatus of the type noted above which is substantially weather-proof and animal-proof but still user friendly.

It is also an object of the present invention to provide an optional divider for the container which creates more than one compartment and allows for multi-material pick up. This would provide the option of collecting more than one type of recyclable or a combination of waste and recyclables.

BRIEF DESCRIPTION OF THE VIEWS OF DRAWINGS

DETAILED DESCRIPTION OF PREFERRED EMBODIMENT

Figure 1:
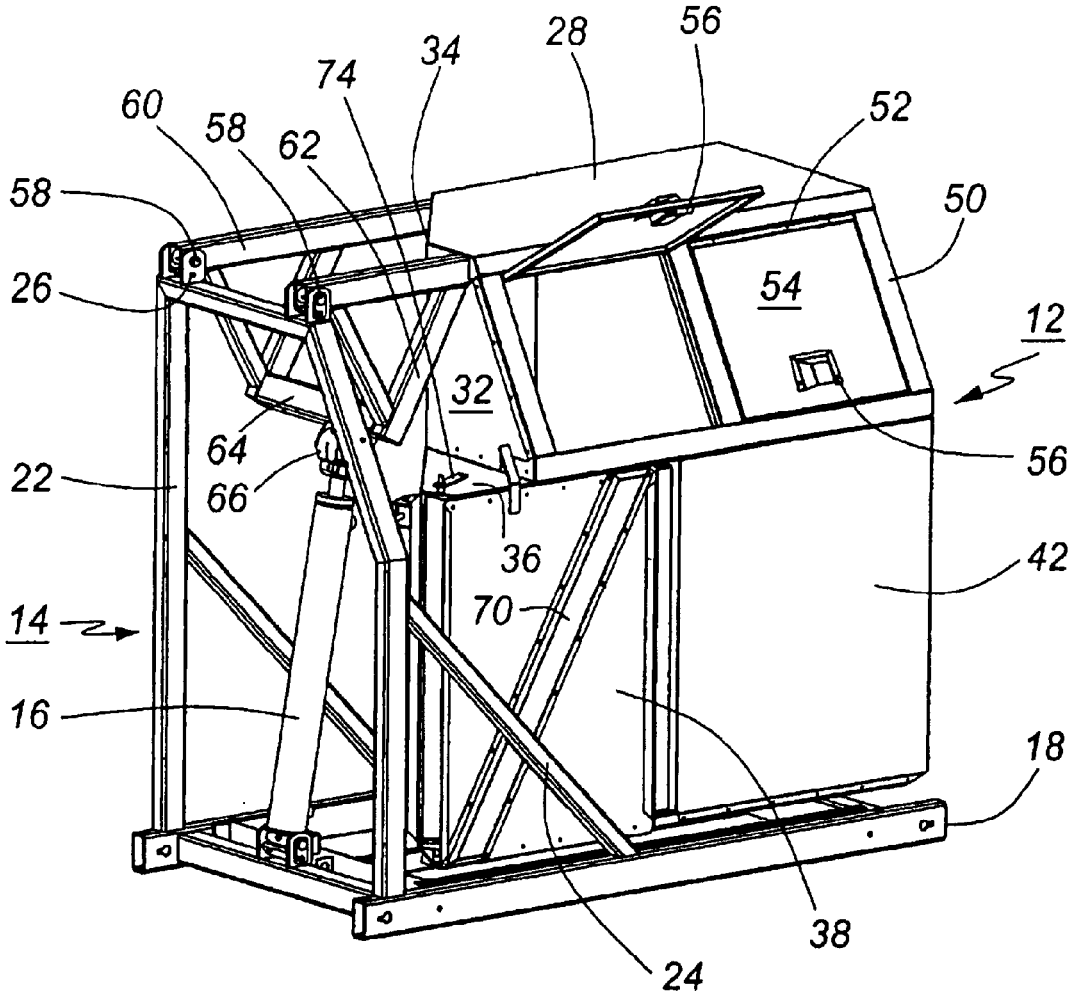
FIG. 1 is a perspective view of the container assembly in loading (down) position with one of the user doors open.

A garbage or recyclable material handling system will be described hereafter which includes material containers 12 each pivotally mounted to respective support frames 14 disposed at desired locations. Each container is mounted for movement between a lower material receiving position and a partially inverted material discharge position. At least one materials collection vehicle (FIGS. 3–6) is provided to communicate with respective containers 12 when in the discharge position to receive the materials discharged therefrom. This vehicle has an actuator system mounted thereto (not shown) including either quick coupling lines, (typically hydraulic lines), to power an actuating device located on the container assembly or, alternatively, an actuator mounted on the vehicle including an arm extendible outwardly of the vehicle and having the actuator secured to the distal end of the arm. The actuator, regardless of its exact form, is adapted to operatively interact between the support frame 14 and the container 12 (when the vehicle is located to receive the materials from the container) and to exert forces therebetween. These forces cause the container 12 to pivot from the receiving position to the discharge position to effect material discharge into the collection vehicle. The container 12 then pivots back to the lower receiving position following which (depending on the form of actuator used) the actuator can be disengaged and the arm retracted inwardly toward the vehicle or the quick coupling lines disconnected and stowed to allow the vehicle to move away from the container assembly.

In the following description and the accompanying drawings, the actuating device is in the form of a hydraulic cylinder 16 which is permanently mounted to interact between the support frame 14 and the container 12, such cylinder 16 being equipped with quick-coupling hydraulic lines of a type well known per se in the art. However, it should be appreciated that the container assembly is adaptable for use with a vehicle mounted actuating cylinder mounted on an extendable arm as fully described in our U.S. Pat. No. 6,077,020 issued Jun. 20, 2000, the disclosure of which is incorporated herein by reference.

The support frame 14 includes spaced parallel base members 18 (optionally provided with concrete ballast and/or with means for connecting same to a heavy concrete base to inhibit tipping over by vandals or animals) connected by transverse members 20 with a pair of uprights 22 fixed to the base members adjacent end portions thereof. A pair of diagonal brace members 24 extending between the uprights 22 and the base members 18 help to provide the required degree of structural stability. The upper ends of the uprights 22 define a spaced pair of pivot points 26 about which the container 12 pivots under the influence of hydraulic cylinder 16 which extends between base transverse member 20 and a portion of the container frame to be described hereafter.

The container 12 is of a sturdy box-like steel construction and includes flat top 28, bottom and rear panels. The side panel 30 which is uppermost as seen in the raised position (e.g. FIG. 2) is also flat while the opposing side panel is in several sections, i.e. an upper section 32 parallel to side panel 30 and a panel section 34 (FIG. 2) which is inclined from rear to front to allow refuse to slide easily out of the container in the raised position. A triangular transition panel 36 extends between the inclined panel section 34 and upper section 32.

Figure 2:
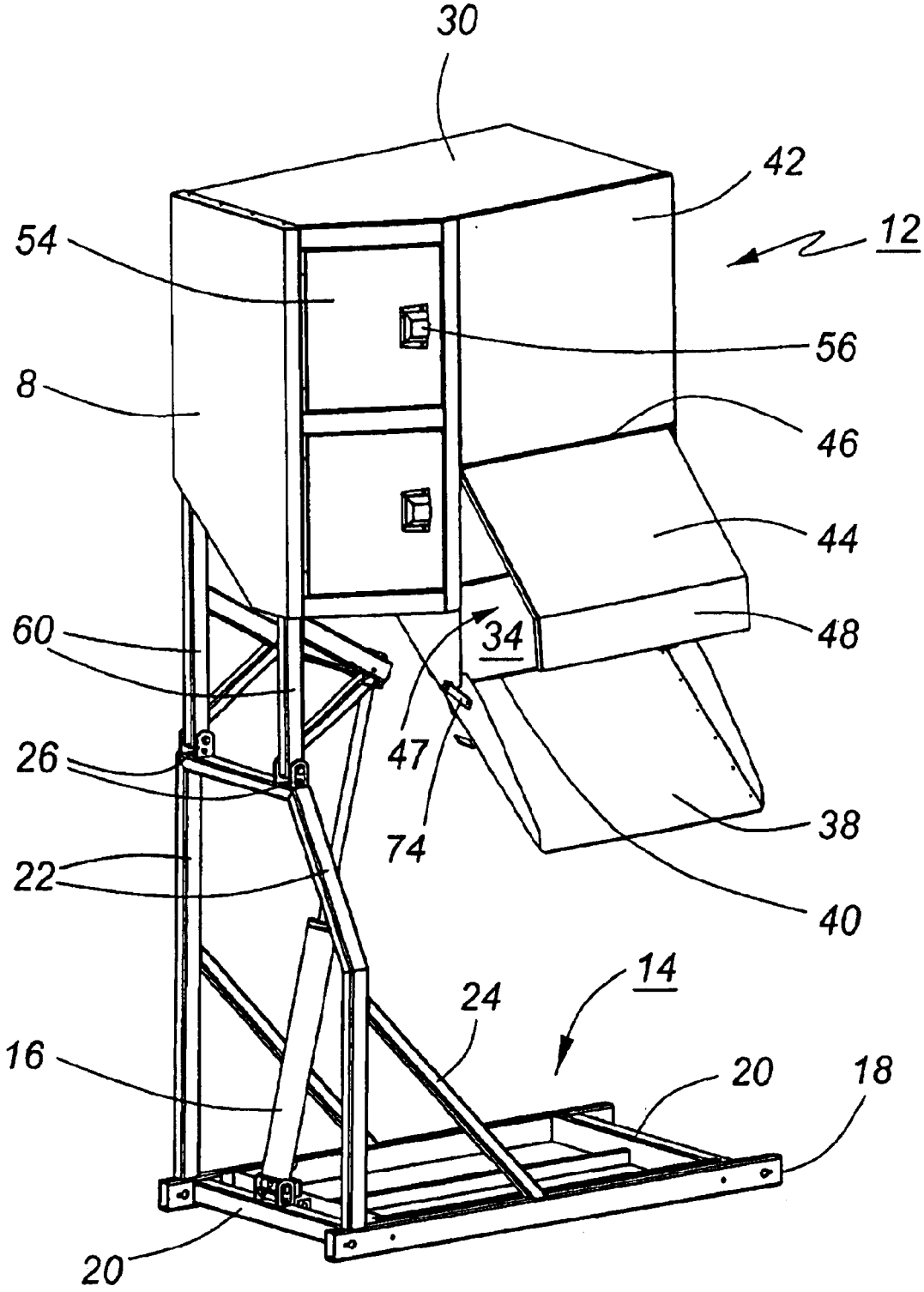
FIG. 2 is a perspective view of the container assembly in the unloading (up) position.
Figure 3:
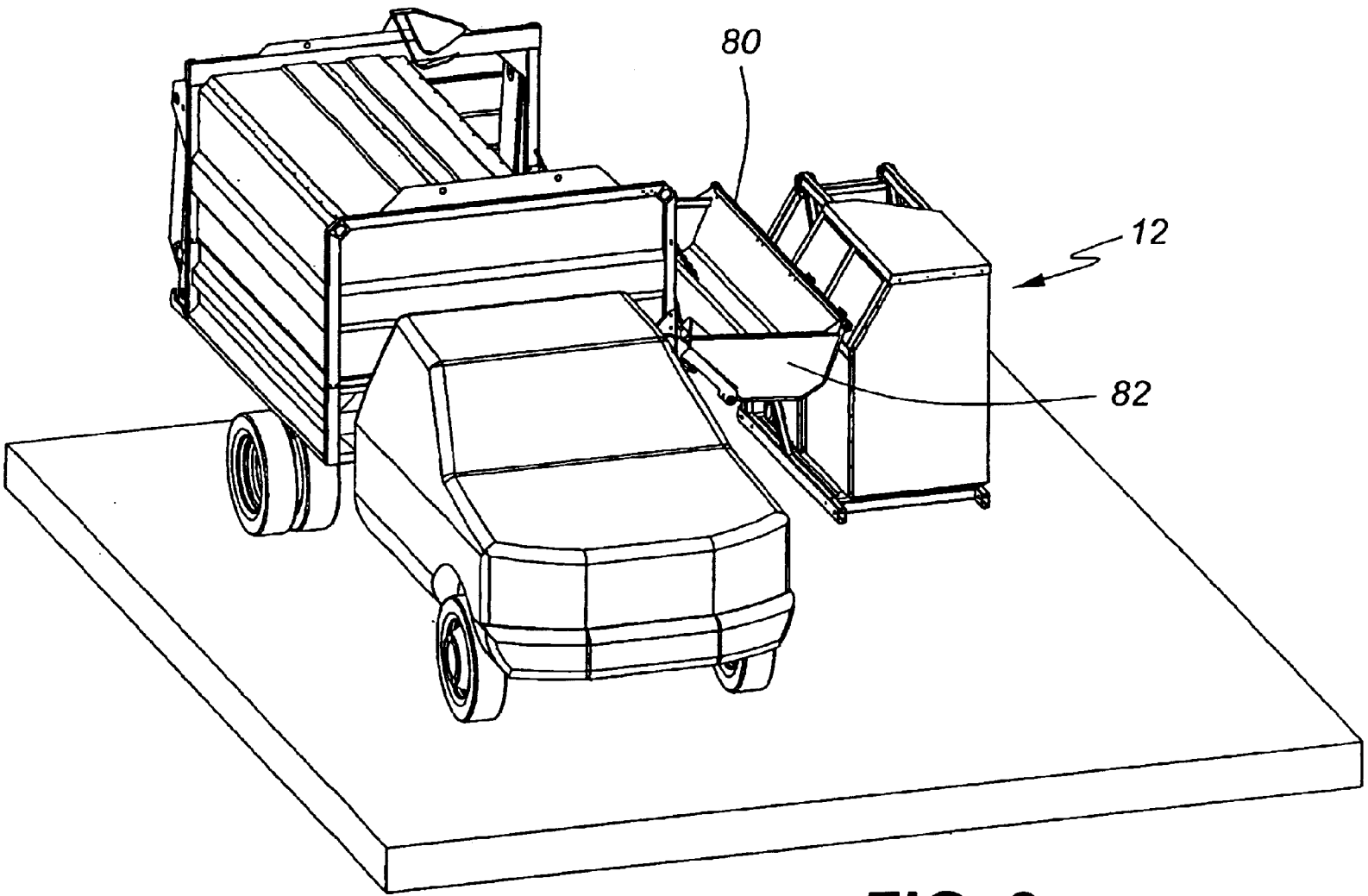
FIG. 3 is a perspective view of the container assembly in the down position beside a collection vehicle.

A discharge chute 38 is pivotally connected (40) to the outer or distal edge of the inclined panel section 34 and is adapted to pivot from a closed position generally flush with a lower fixed frontal panel 42 of the container (FIG. 1) to cover a discharge port in the lower frontal face of the container to the open discharge position of FIG. 2. The side edge of frontal panel 42 has a top discharge lid 44 freely hinged (46) thereto which opens sufficiently as to allow refuse to escape from the container 12 via the inclined panel section 34, the discharge port 47 and the discharge chute 38. Top discharge lid 44 has an inwardly angled outer edge portion 48 which engages and slides on the discharge chute as the latter is being closed so that the discharge lid 44 underlies the discharge chute 38 when the latter is fully closed to cover the discharge port and in parallel proximity to the lower fixed front panel section 42.

The upper frontal portion 50 of the container slopes rearwardly and has mounted therein a pair of hinged (52) access doors 54 each having a hand-operated latch 56 (preferably animal-proof) thereon whereby to enable persons to readily open the doors 54 for placement of refuse into the container interior.

The container 12 is pivotally mounted to the support frame 14 via pivot pins 58 mounted at and defining pivot points 26 at the upper ends of the frame uprights 22 noted above. Pivot points 26 define a container rotation axis extending normal to the frontal face of the container. The container frame (mostly hidden behind the various panels noted above) includes a pair of spaced parallel arm portions 60 which extend away from and parallel to the container top panel 28 and terminate at the pivot points 26 defined by pins 58. These parallel arm portions 60 are also each provided with a moment arm defining V-shaped strut 62, the apices of the V-struts being connected via a short cross beam 64, the centre point of the latter being connected via a pivot pin and bracket 66 to the upper end of the ram of the aforementioned hydraulic cylinder 16 which provides the motive power for rotating the container 12 relative to the support frame 14.

Returning now to the discharge chute 38 as seen in FIG. 1 in the closed position, it will be noted that it has a diagonally arranged rub strip 70 fixed to its frontal surface. This rub strip 70 is closely adjacent to the inner surface of the front diagonal brace member 24 of the support frame and thus keeps the discharge chute 38 in the closed position when the container 12 is in the lowered position of FIG. 1. As the container is rotated to the raised position shown in FIG. 2, the discharge chute rub strip 70 loses contact with the frontal diagonal brace member 24 and chute 38 is free to open under the influence of gravity and the pressure of refuse within the container 12 whereby the discharge chute 38 moves to the lowered open position shown in FIG. 2 while the discharge lid 44 is opened by the pressure of the refuse being dumped out of the container.

Once the dumping of refuse is complete, pressure to the hydraulic cylinder 16 is released causing the container to rotate and the rub strip 70 on the chute 38 to come into contact with the frame brace 24 thus exerting a camming action on chute 38 which swings the discharge chute (along with the discharge lid 44) to the closed position as shown in FIG. 1. To reduce friction, the rub strip 70 and/or the inner surface of the front frame brace 24 may be coated with a low friction material such as nylon.

Figure 4:
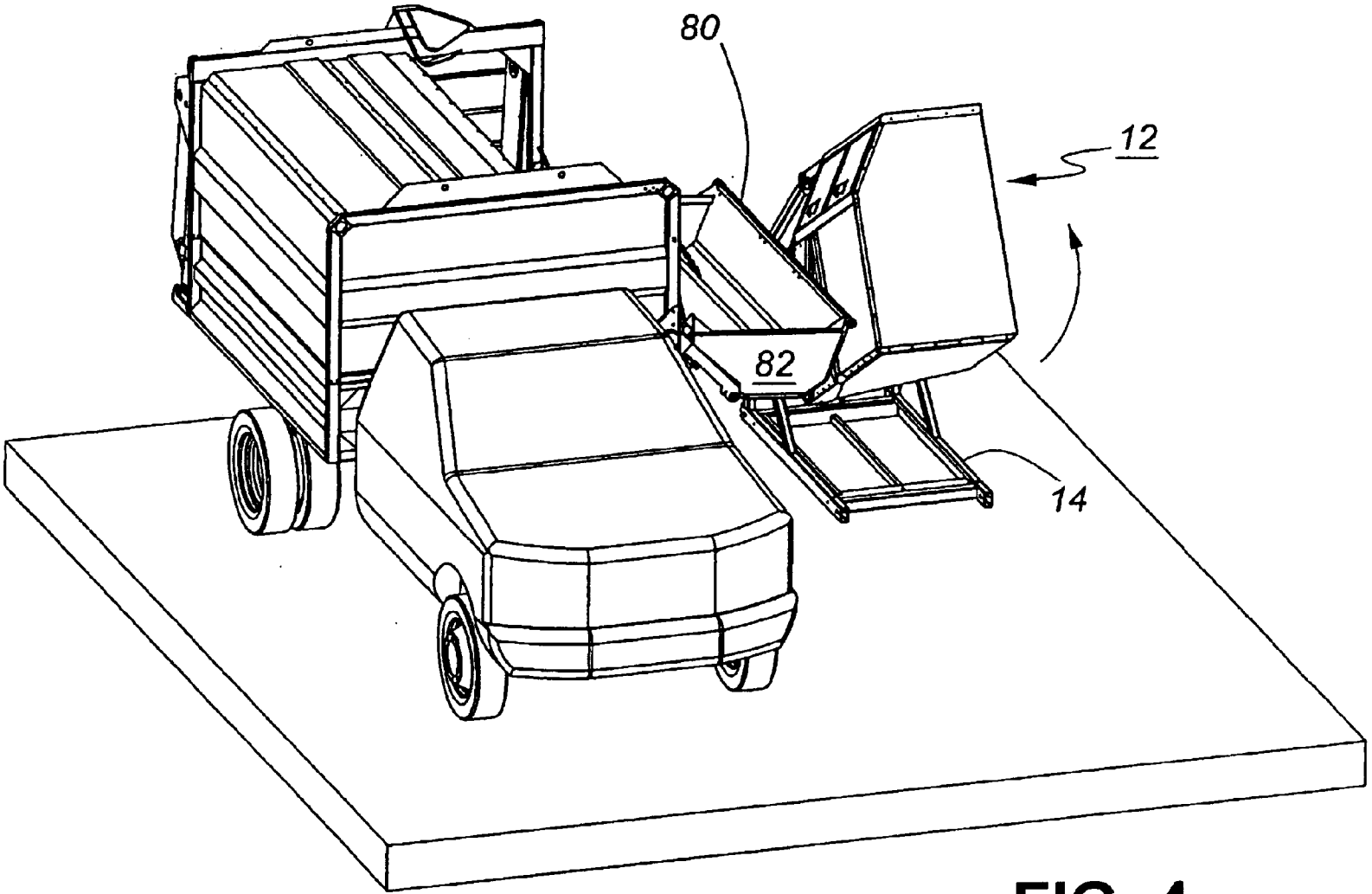
FIG. 4 is a perspective view of the container assembly in the partially inverted position beside the collection vehicle.

To prevent premature opening of the discharge chute 38 as the container 12 is rotated upwardly, an air damping cylinder 74 is connected between the chute 38 and the container 12. Thus, when the rub strip clears the brace 24, the chute only opens slowly thus avoiding interference between the chute and the outer edge 80 of the loading bucket 82 of the side loading refuse vehicle as shown in FIG. 4. The brace 24 and rub strip 70 relative orientations can of course be modified to provide the desired action to suit the particular design circumstances encountered.

Figure 5:
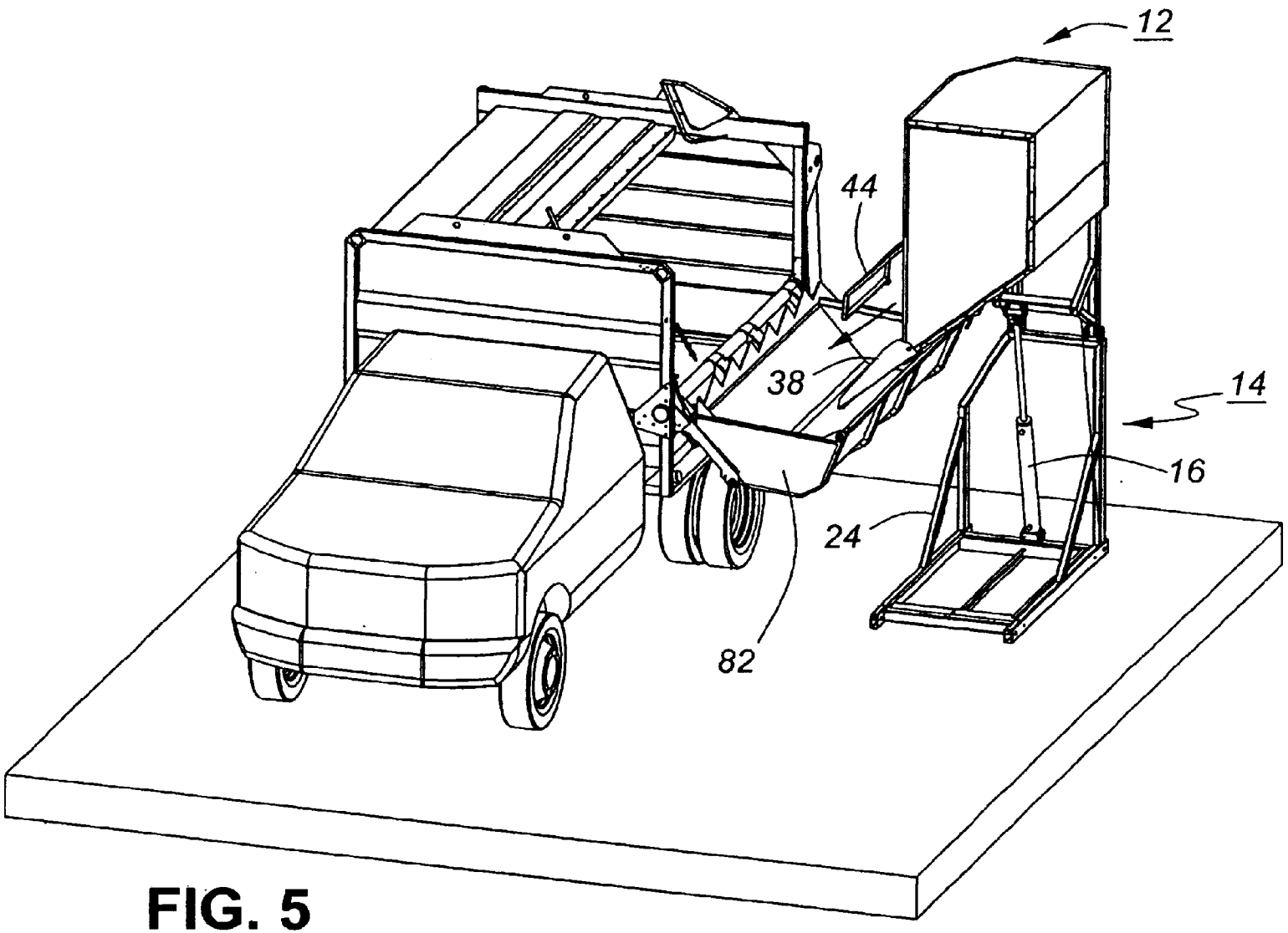
FIG. 5 is a perspective view of the container assembly in the up position for dumping its contents into the loading hopper of the collection vehicle.
Figure 6:
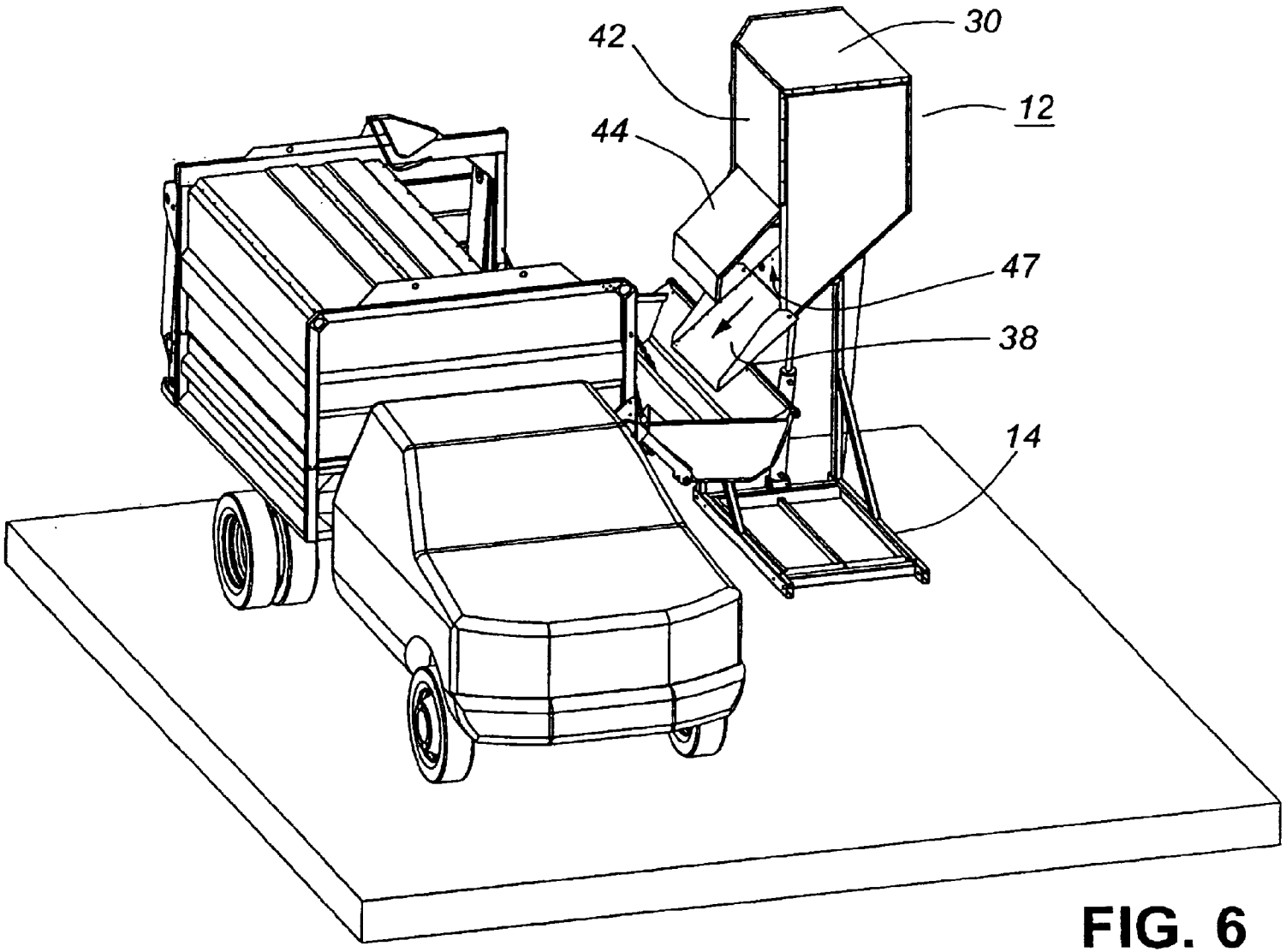
FIG. 6 is a perspective view of the container assembly in the up position for dumping its contents into the loading hopper of the collection vehicle as in FIG. 5 but taken from a different angle.

The operating sequence is fairly simple. The refuse vehicle (FIG. 3) drives alongside the container system and its side loading bucket 82 lowered. The container 12 is then pivoted upwardly (FIG. 4). Referring to FIGS. 5 and 6, as the container 12 approaches the full "up" position, the discharge chute 38 swings downwardly thus allowing the contents 12 of the container to discharge into the vehicle bucket 82. The container is then allowed to rotate by gravity back to its lower position (it being noted that a single acting cylinder 16 is sufficient as the container does not go "over-center") and the discharge lid 44 and discharge chute 38 automatically close as explained above. The loading bucket 82 of the vehicle is closed in the usual way and the vehicle moves on to the next container location where the same process is repeated.

In an alternative container arrangement, the container includes a divider which not only allows the collection of source separated containers, but also could be used to control the flow of the material being emptied if the receiving bucket on the collection vehicle had less capacity than the hopper.

A preferred embodiment of the invention has been described by way of example. Those skilled in the art will realize that various modifications and changes may be made while remaining within the spirit and scope of the invention. Hence the invention is not to be limited to the embodiment as described but, rather, the invention encompasses the full range of equivalencies as defined by the appended claims.

I claim:

1. A refuse container assembly comprising a support frame and a refuse container pivotally mounted to said support frame for movement between a lower refuse receiving position and a raised refuse discharge position, said container having an access door in an upper portion of the container for allowing placement of refuse into the container, and a discharge port located in a lower portion of the container, and a discharge chute over which discharging refuse is guided, said discharge chute mounted to said container and movable between a closed position over the discharge port to close the latter and an open position allowing discharge of the contents of the container through said port, and means to allow the chute to move to the open position when the container is moving towards or is in the raised position and to lock said chute in the closed position over said discharge port when said container is in its lower position.

2. The assembly of claim 1 wherein said means to allow the chute to move to the open position and to lock the chute in the closed position comprises means interacting between the chute and a portion of said frame.

3. The assembly of claim 2 wherein said means interacting between said discharge chute and the frame portion comprises rub strips on portions of at least one of said chute and said frame portion which interact together to close the chute as the container moves toward the lower position.

4. The assembly of claim 1 wherein said container is arranged such that it does not go over center in its raised position whereby it can return to its lower position by gravity.

5. A refuse container assembly comprising a support frame and a refuse container pivotally mounted to said support frame for movement between a lower refuse receiving position and a raised refuse discharge position, said container having an access door in an upper portion of the container for allowing placement of refuse into the container, and a discharge port located in a lower portion of the container, and a discharge chute mounted to said container and movable between a closed position, wherein both said access door and said discharge port are located on the same face of the container over the discharge port to close the latter and an open position allowing discharge of the contents of the container through said port, and means to allow the chute to move to the open position when the container is moving towards or is in the raised position and to lock said chute in the closed position over said discharge port when said container is in its lower position.

6. The assembly of claim 5 wherein said container is adapted to rotate on said frame about an axis which is normal to said same face of the container.

* * * * *